US005418985A

United States Patent [19]

Antoine

[11] Patent Number: 5,418,985

[45] Date of Patent: May 30, 1995

[54] MASSAGE SHOWER SYSTEM

[75] Inventor: Robert Antoine, Varennes-Vauzelles, France

[73] Assignees: Andre Belilty, Elancourt; Robert Decup, Puteaux, both of France

[21] Appl. No.: 119,118

[22] Filed: Oct. 27, 1993

[30] Foreign Application Priority Data

Mar. 20, 1991 [FR] France ..... 91 03380

[51] Int. Cl.[6] ..... A47K 3/22

[52] U.S. Cl. ..... 4/615; 4/601

[58] Field of Search ..... 4/567, 568, 569, 570, 4/601, 615

[56] References Cited

U.S. PATENT DOCUMENTS

| | | | |
|---|---|---|---|
| 833,527 | 10/1906 | Jackson | 4/601 X |
| 1,148,968 | 8/1915 | Jablonski | 4/567 |
| 1,501,762 | 7/1924 | Ferguson | 4/601 X |
| 4,274,400 | 6/1981 | Baus | 4/615 X |
| 4,724,553 | 2/1988 | Bianchi | 4/615 |
| 4,749,130 | 6/1988 | Utzinger | 4/615 X |
| 4,964,399 | 10/1990 | Faimali | 128/66 |

FOREIGN PATENT DOCUMENTS

| | | |
|---|---|---|
| 0313525 | 4/1989 | European Pat. Off. . |
| 0336845 | 10/1989 | European Pat. Off. . |
| 1028528 | 5/1953 | France . |
| 363449 | 4/1987 | Germany . |

*Primary Examiner*—Robert M. Fetsuga
*Attorney, Agent, or Firm*—Fisher, Christen & Sabol

[57] ABSTRACT

The massage shower system (6) includes injectors (7) for directing jets of water and air and water under pressure substantially radially towards the body of a patient standing up, a frame (9, 42, 44) supporting the injectors (7), and an actuator (10, 43) for communicating to the frame a vertical reciprocating movement with respect to the patient. The frame is displaceable between a lower position and an upper position along the vertical direction, according to an ascending movement the speed of which varies from a minimum to a maximum value.

20 Claims, 4 Drawing Sheets

MASSAGE SHOWER SYSTEM

The present invention relates to a massage shower system.

The present invention also relates to a massage shower cubicle equipped with a massage shower system according to the invention.

Massage shower systems are known which comprise injectors for directing jets of water or air and water under pressure substantially radially towards the body of a patient standing up.

These systems generally comprise one or more fixed vertical ramps each bearing a certain number of fixed injectors, and mechanisms for controlling these jets to supply them one after the other from bottom to top and/or at a certain rhythm.

A system is also known, comprising a brush vertically mobile along the patient's body, associated with a fixed jet.

Similarly, a massage shower system is known, particularly from EP-A-0 313 525, comprising injectors for directing jets of water or air and water under pressure substantially radially towards the body of a patient standing up, a frame supporting the injectors and animated by a vertical movement with respect to the patient, and actuation means for communicating to the frame a vertical reciprocating movement with respect to the patient.

The frame is animated by a movement at constant speed between two lower and upper levels spaced apart in vertical direction.

These systems all have actions forcibly limited to successive physiological regions of the body of a patient and present, for the masseurs and kinesitherapists who are men skilled in the art, the drawback of literally "chopping" and "cutting up" the whole body of said patient into successive slices.

In no way do these means and systems reproduce the progressive, accelerated, continuous and unctuous gestures of the men skilled in the art, and even less so the gradual and increasing actions and pressures of the hands and fingers of a masseur, always directed in the direction rising from the ankles towards the heart.

For the same reasons, these apparatus can in no way be suitable for effecting and executing a veritable lymphatic drainage correctly.

It is an object of the present invention to overcome the drawbacks of the known massage shower systems and to propose a shower system for massage by jets of water or air and water under pressure reproducing as well as possible the continuous and progressive actions and pressures of the gestures of a masseur.

According to the invention, the massage shower system of the type mentioned above is characterized in that the actuation means comprise means for communicating to the means forming frame, between two lower and upper levels spaced apart from each other in vertical direction, an ascending movement of which the speed increases and passes from a substantially minimum value to a substantially maximum value when the means forming frame pass from the lower level to the upper level.

The massage effected by the jets of water or air and water under pressure thus has a speed progressively increasing in the direction rising towards the patient's heart, and considerably approaches the progressive gesture of a masseur.

According to an interesting version of the invention, the body of a patient being divided heightwise into a plurality of regions capable of being massaged separately independently of one another or successively one after the other, the actuation means comprise means for communicating to the means forming frame, for each of these regions, an ascending movement whose speed increases when the means forming frame pass from the lower part to the upper part of said region.

The system of the invention thus comprises all the suppleness necessary for a man skilled in the art to adapt the functioning of said system to the particular case of each of his patients, both from the standpoint of morphology and from the standpoint of the mode of treatment required.

The shower system allows both a localized treatment of a region of the body of the patient, for example the legs or hips or back, and an action on the whole surface of the body. It thus responds to all the needs of use of massage specialists.

According to a preferred embodiment of the invention, the system comprises means for varying the pressure of the water at the same time and in the same direction as the speed of the means forming frame.

The jets of water under pressure thus exert an action of massage which reproduces both the increasing pressure and the increasing speed of the masseur's gesture.

According to another aspect of the invention, the shower cubicle according to the invention is characterized in that it comprises a massage shower system according to the invention.

According to a preferred version of the invention, the shower cubicle comprises water-tight walls and is adapted to be filled at least partially with water, the massage shower system being adapted to a movement of the means forming frame and to a functioning of the injectors in the water.

Other particularities and advantages of the invention will appear in the following detailed description.

In the accompanying drawings, given solely by way of non-limiting example:

Figure 1:
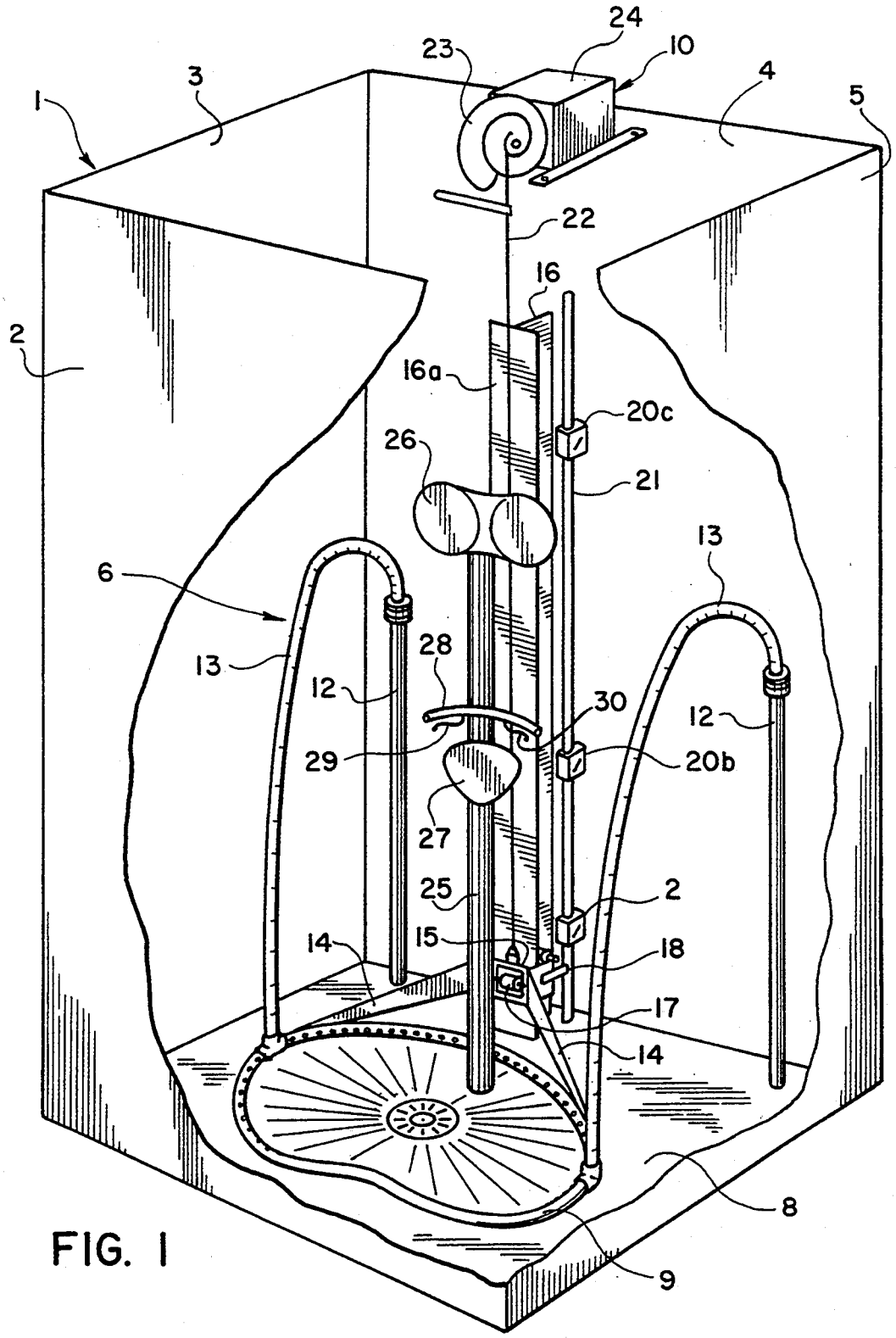
FIG. 1 is a schematic view in perspective of a shower cubicle equipped with a massage shower system according to one embodiment of the invention.

In the embodiment of FIG. 1, the massage shower cubicle 1 comprises water-tight walls 2, 3, 4, 5 and is adapted to be filled at least partially with water.

The shower cubicle 1 is equipped with a massage shower system 6 comprising injectors 7 for directing jets of water or air and water under pressure substantially radially towards the body of a patient standing up at the centre of the cubicle 1, on the floor 8 thereof.

According to the invention, this massage shower system 1 comprises a frame 9 supporting the injectors 7 and mobile vertically in a relative movement with respect to the patient, and actuation means 10 for communicating to the frame 9 a relative vertical movement with respect to the patient.

In the embodiment shown, the frame 9 is mobile with respect to the walls 2, 3, 4, 5, and to the floor 8 of the shower cubicle 1, but it would be possible to make a floor 8 mobile with respect to the walls 2 to 5 of the cubicle and to the frame 9, or any other equivalent system.

Figure 3:
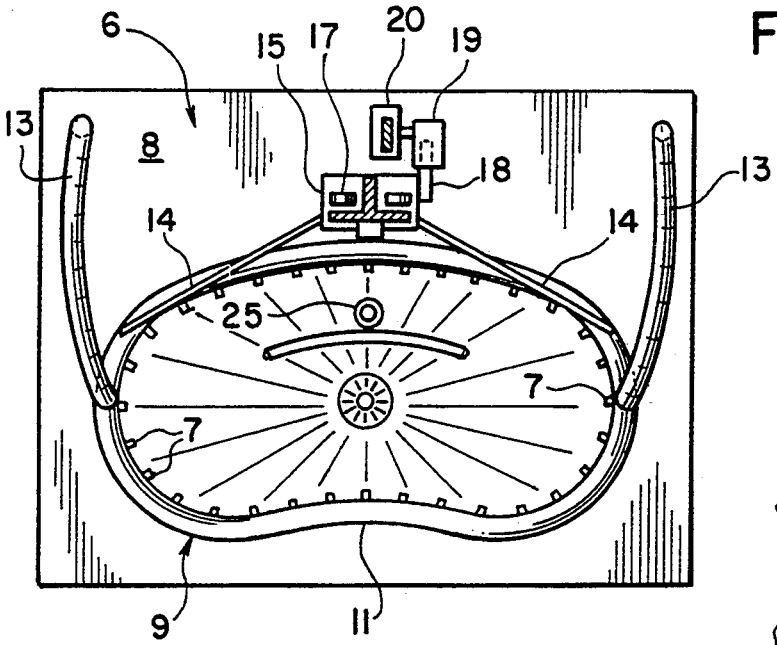
FIG. 3 is a schematic plan view of the massage shower system of FIG. 1.
Figure 2:
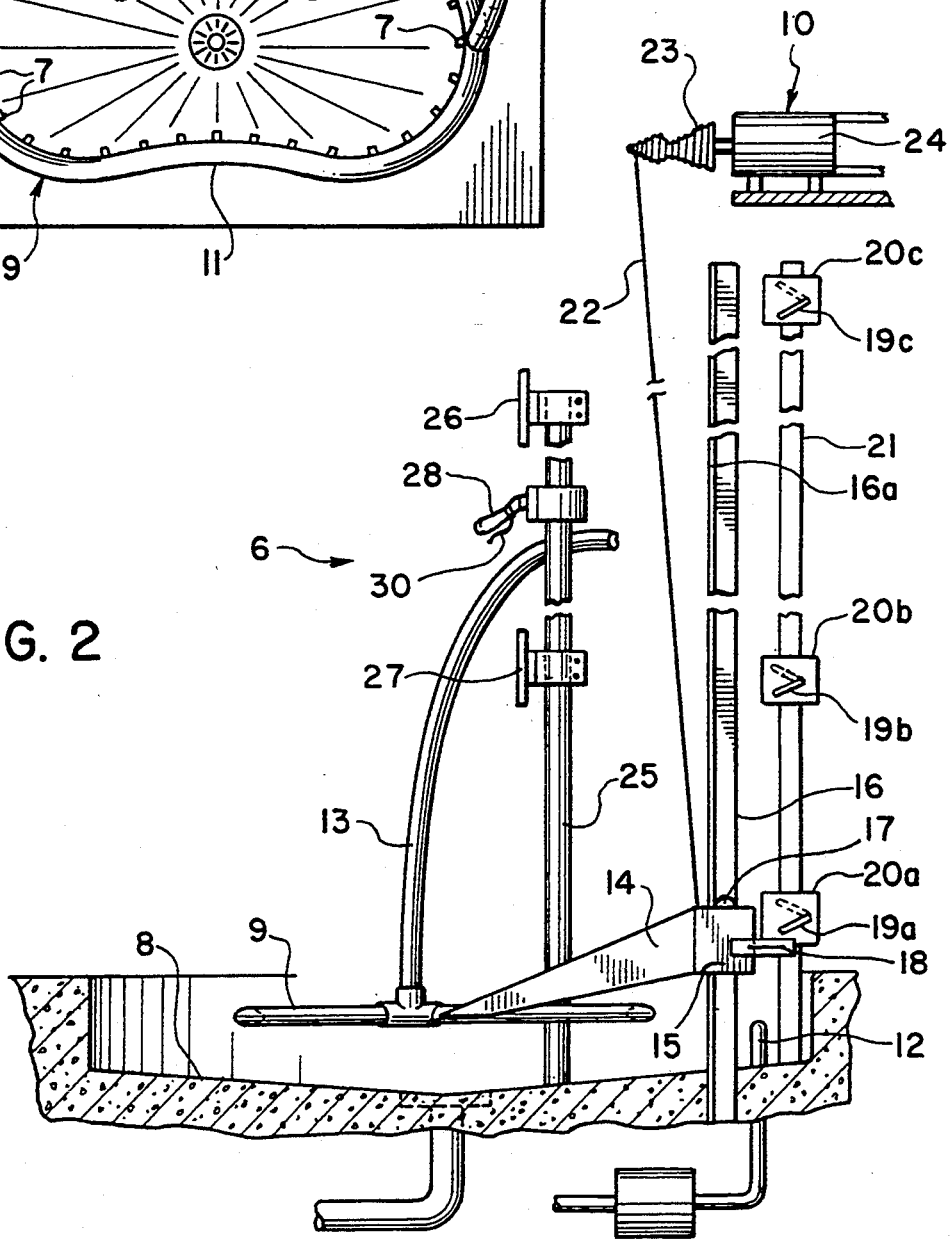
FIG. 2 is a schematic side view, partially in section, of the massage shower system of FIG. 1.

As shown in detail in FIGS. 2 and 3, the frame 9 is in one piece and is generally oval in shape; this oval comprises in a zone of greater radius a median part 11 inwardly re-entrant and slightly concave, corresponding to the patient's back.

The frame 9 is a tubular frame and bears the injectors 7 which are oriented substantially radially. The injectors 7 are fixed in manner adjustable and orientable in any manner on the frame 9. Their number may be any one and variable, adapted to the case of the patient to be treated.

The injectors 7 are injectors of any known type capable of directing towards the patient a jet of water under pressure of any shape, for example a cylindrical jet or a jet flattened as a brush, the water under pressure arriving at the frame 9 via the fixed conduits 12 connected to the frame 9 by the flexible pipes 13 whose length is adapted to the amplitude of the displacement of the frame 9.

The injectors 7 may also be of the type adapted to direct jets of water and air under pressure, in particular hot air. The injectors 7 are then generally connected in any known manner, for example by a flexible pipe connecting each injector to a second tubular frame (not shown), to a source of air under pressure (not shown).

In the example shown, the frame 9 is connected by two arms 14 to a carriage 15 mobile along a vertical post 16. The post 16 has a cross section in T form, and the carriage 15 comprises rollers 17 placed on either side of the upper bar **16*a* of the T to roll therealong and to guide the carriage 15**.

The carriage 15 bears a projecting finger 18 which is adapted to mesh, when the carriage 15 moves along the post 16, with the rocking lever 19 of a plurality of pneumatic and/or hydraulic contactors 20 placed in adjustable manner on a support 21 parallel to the post 16. The function of these contactors 20 will be seen hereinafter.

The carriage 15 moves along the post 16 under the action of the actuation means 10 constituted by a cable 22 which winds on a drum 29 driven by a metor 24.

A mast 25 located inside the frame 9 bears two shields 26, 27 displaceable along the mast and intended to protect from the force of the jets the sensitive parts of the body of a patient at the level of the chest and lower abdomen. The mast 25 also bears a bearing and holding bar 28 on which are fixed two handles 29 and 30 which the patient must hold permanently and of which the function will be seen hereinafter.

It is known that, in the art of massage, the body of a patient is traditionally divided heightwise into a plurality of regions capable of being massaged separately independently of one another or successively one after the other. These regions successively include the legs, from the ankles or even the feet up to the knees, then the thighs, from the bottom to the top thereof, the hips, from the top of the thighs up to the waist, finally the back, from the waist up to the shoulders.

It is also known that masseurs, particularly for lymphatic drainage, firstly begin with the ankles or feet of their patients. They then continue their more or less insistent manipulations, rising along the calves towards the knees, then from the knees along the thighs towards the pelvis and finally, from the pelvis up to the region of the heart in the chest.

During these manipulations, the masseurs have ample, continuous gestures which accelerate on rising towards the heart, and exert on the tissues a pressure which increases when rising towards the heart. These principles are valid both for a localized action on one of the regions mentioned and for a massage on the whole body.

In order to reproduce these basic characteristics of the masseurs' gestures, the means 10 for actuating the frame are adapted to communicate to the frame 9, for each of the regions of the body of a patient, an ascending movement whose speed increases when the jets of water or air and water pass from the lower part to the upper part of said region. Naturally, this speed returns to its minimum value on arriving in the region of the body located immediately above the preceding one. In parallel, the massage shower system 6 also comprises means which will be detailed hereinbelow for varying the pressure of the water at the same time and in the same direction as the speed of the frame 9.

Figure 4:
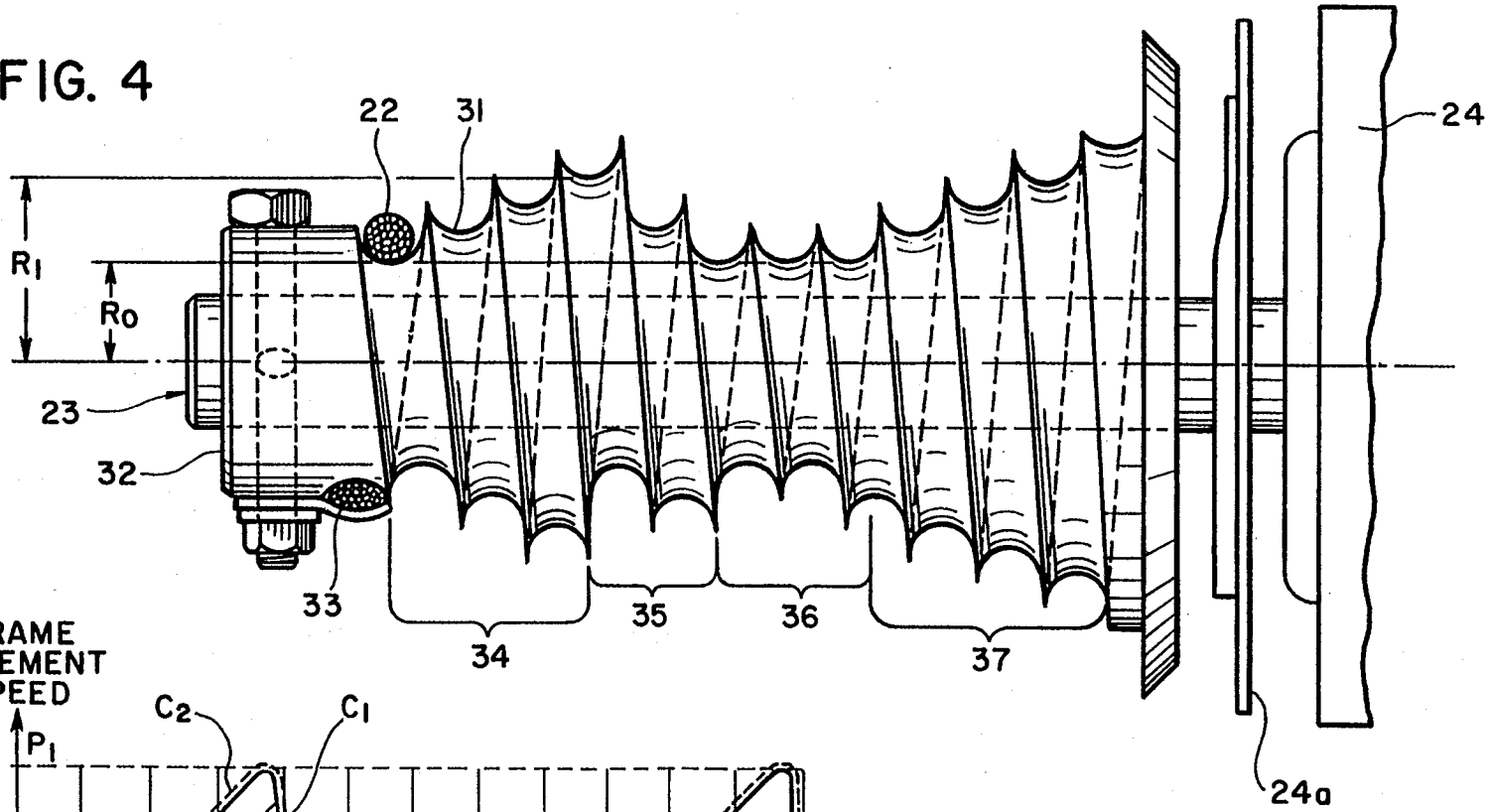
FIG. 4 is a much enlarged view in elevation of the drum for winding the cable of the shower system of FIG. 1.

Thus, and as shown in detail in FIG. 4, the drum 23 comprises on its peripheral surface a helical groove 31 whose radius is variable and increases in order to increase the speed of the jets of water or air and water between the lower part and the upper part of each region of a patient's body, and returns very rapidly to its minimum value on arriving in the region located immediately above the preceding one.

To that end, the drum 23 comprises from its longitudinal end 32 to which is fixed an end 33 of the cable 22, a first zone 34 whose radius increases from a minimum value $R_0$ to a value $R_1$, this zone 34 corresponding to the region of the legs going from the ankles to the knees, a second zone 35 whose radius increases from said minimum value $R_0$ and which corresponds to the region of the thighs going from the knees to the top of the thighs, a third zone 36 whose radius is constant at its minimum value $R_0$ and which corresponds to the region of the hips going from the top of the thighs to the waist, and a fourth zone 37 whose radius increases from said minimum value $R_0$ and which corresponds to the region of the back between the waist and the shoulders.

Figure 5:
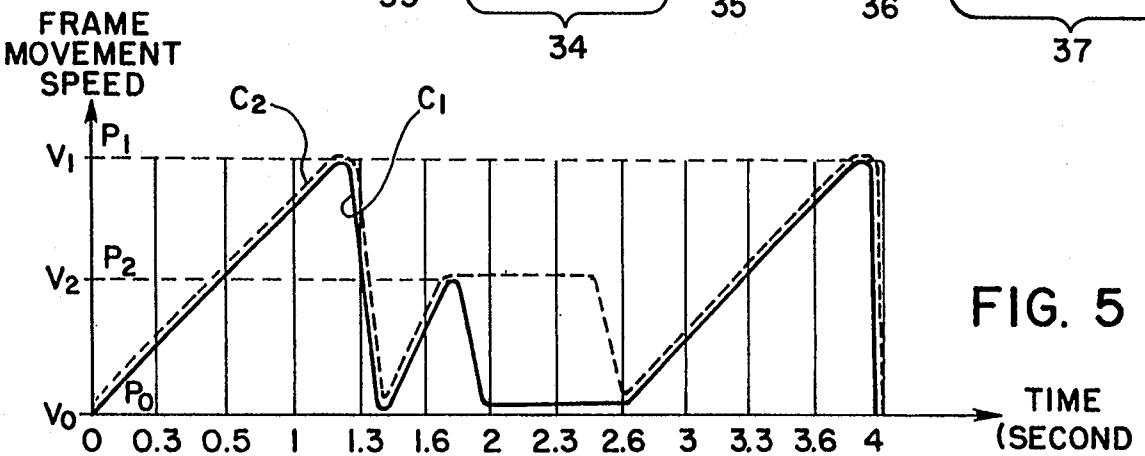
FIG. 5 shows a curve indicating the variation in the speed of the vertical movement of the frame of the shower system of FIG. 1.

Thus, and as shown by curve C1 in solid lines in FIG. 5, as soon as the motor 24 rotates at constant speed, the frame 9 rises along the post 26; its speed increases by a value $V_0$, which corresponds to the minimum radius $R_0$, up to a value $V_1$ which corresponds to the maximum radius $R_1$, redescends very rapidly to $V_0$, rises up to a value $V_2$ less than $V_1$, remains at value $V_0$ for the region of the hips, then increases again from $V_0$ to $V_1$ for the region of the back.

During the same period of time, the pressure of the water, or of the air and water, passes from a value $P_0$ which is for example substantially zero, to a value $P_1$ substantially maximum, redescends rapidly to $P_0$, rises to a value $P_2$ less than $P_1$, remains at value $P_2$ for the region of the hips, returns to $P_0$ then increases from $P_0$ to $P_1$ for the region of the back, in perfect synchronization with the speed, as indicated by curve C2 in broken lines in FIG. 5.

As indicated in the Figure, the total path from the ankles to the shoulders may last for example about 4 seconds, the frame passing after about 1.3 seconds at the level of the knees, after about 2 seconds at the level of the top of the thighs, and after about 2.6 seconds at the level of the waist. The return path is rapid and is effected for example in 1.5 or 2 seconds.

The movement of the carriage 15 is adjusted and adapted to the size of the patient by means of the contactors 20. Contactor 20*a* is adjusted at the foot of the support 21 so that its lever 19*a* rocks downwardly under the action of the finger 18 when the jets of water under pressure are at the level of the feet or ankles of the patient, carriage 15 being in its extreme lower position. The contactor 20*c* is placed at the top of the support 21 so that its lever 19*c* rocks upwardly under the action of the finger 18 when the jets of water under pressure are at the level of the patient's shoulders, carriage 15 being in its extreme upper position. Other contactors such as 20*b* may be placed in an intermediate position which will be specified hereinbelow. It is also possible to have a patient of small stature sit on a stool of adjustable height.

In order further to improve the suppleness and operational safety of the system 6, the handle 29 on the bearing and holding bar 28 must be gripped by the patient for the system 6 to function; if the patient releases it, the system stops. On the contrary, the handle 30 is a handle for adjustment at the disposal of the patient who, by gripping it more or less, can adjust a parameter such as the speed of rotation of the motor 24 and/or the maximum pressure of the water of the jets. Similarly, a safety clutch indicated schematically at 24*a* in FIG. 4, is intercalated between the motor 24 and the drum 23.

Figure 6:
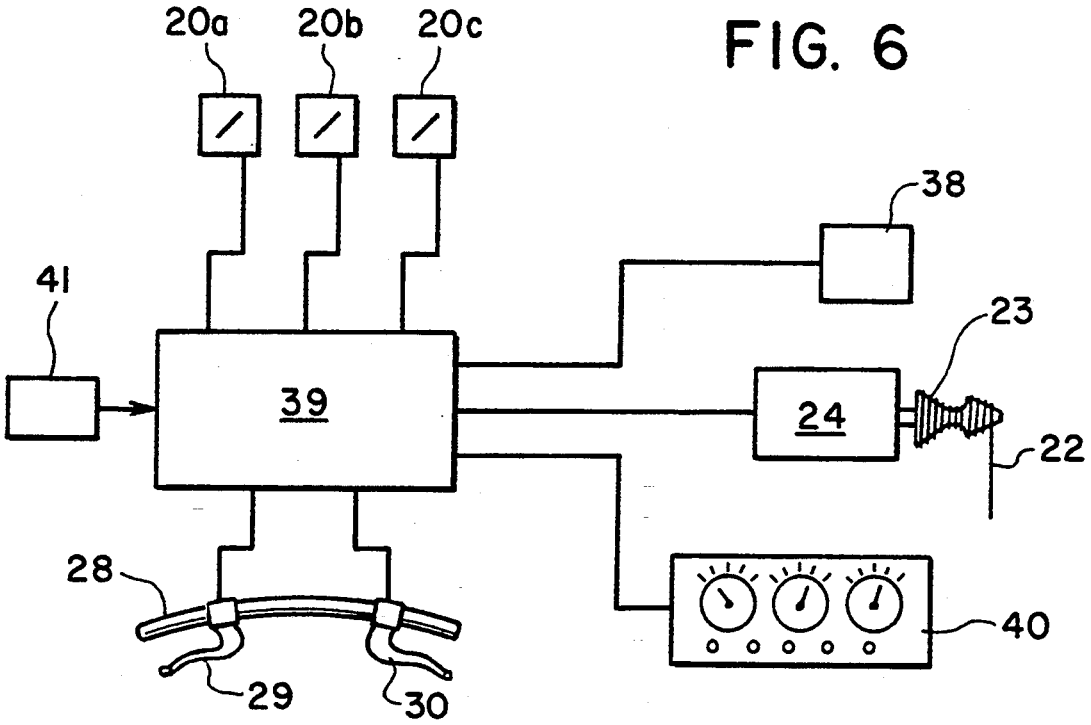
FIG. 6 shows a diagram of the links allowing control of the movement of the frame of the shower system of FIG. 1.

Finally, as shown schematically in FIG. 6, the system 6 comprises a control member 39 associated with a control and signalling board 40 at the operator's disposal.

The control member 39 is thus connected to the board 40, to the contactors 20*a*, 20*b*, 20*c*, to handles 29, 30, to the valve 38 for regulating the pressure of water, to the motor 24 and to a source of energy 41 which is preferably a source of compressed air but which may also be a source of hydraulic liquid under pressure or a source of low voltage electrical current.

Figure 7:
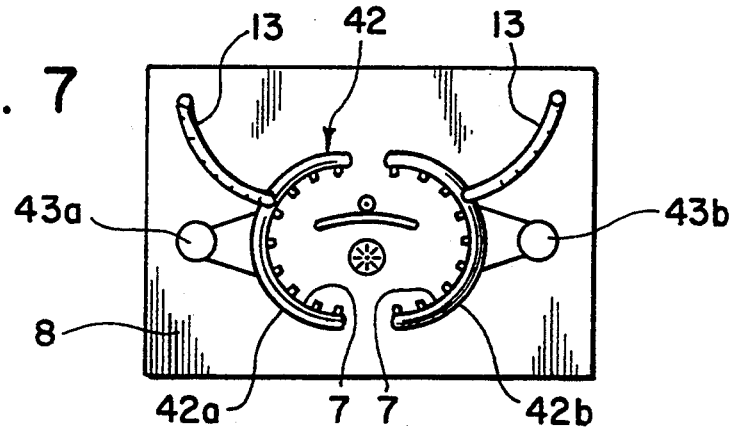
FIG. 7 is a reduced view similar to FIG. 3 of another embodiment of the shower system according to the invention.

In the embodiment of FIG. 7, the frame 42 is constituted by two individual sectors 42*a*, 42*b* independent of one another and each actuated by respective individual actuation means 43*a*, 43*b* independent of each other, which are in this example telescopic jacks, preferably pneumatic or hydraulic.

Figure 8:
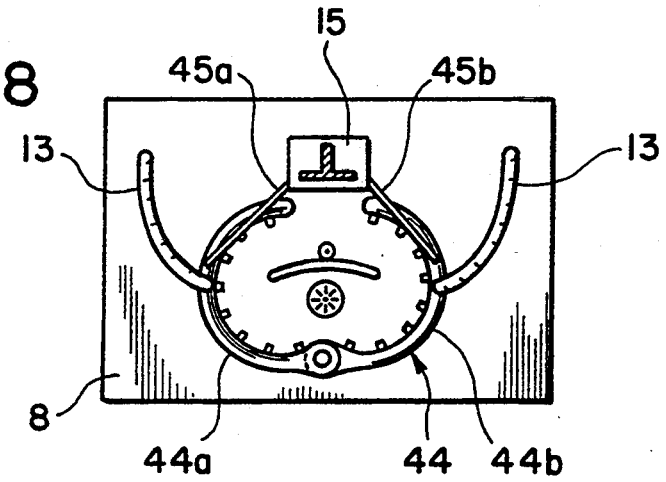
FIG. 8 is a view similar to FIG. 7 of another embodiment of the shower system according to the invention.

In the embodiment of FIG. 8, the frame 44 is constituted by at least two arcuate parts 44*a*, 44*b* articulated on one another to adapt to the morphology of a patient. These articulated parts 44*a*, 44*b* are fixed to the carriage 15 by arms 45*a*, 45*b* articulated respectively on the carriage 15 and on the corresponding arm 44*a*, 44*b*, these arms being blocked by any blocking means (not shown).

The mode of operation of the cubicle and of the massage shower system according to the invention will now be described.

The cubicle may be more or less filled with water as desired, the level of the surface of the water arriving at maximum at the level of the patient's shoulders, so as to add the effect of hydrostatic pressure on the lower ends to the effect of massage of the system of the invention.

The means of the massage shower system 6 which have just been described are obviously adapted to a movement of the frame 9 and of the carriage 15 and to an operation of the injectors 7 in the water.

The frame 9 is, at the start, in its lower position. When the patient presses on the two handles 29 and 30, the motor 24 is supplied and rotates the drum 23 on which the cable 22 winds. The water circuit supplying the injectors is open, and the injectors direct towards the patient jets of water or air and water under pressure which move in an ascending movement whose speed varies according to the diagram of FIG. 5. The pressure of the water may also vary at the same time and in the same sense as the speed.

The jets of water under pressure therefore exert on the patient's body an effect comparable to that of the gestures of a masseur.

When the carriage is at the level of the patient's shoulders, the lever 19*c* of the contactor 20*c* rocks under the action of the finger 18, which has for its effect to control a reversal of the direction of rotation of the motor 24. The drum 23 then unwinds the cable 22 to cause the frame 9 to redescend to its lower position, preferably at a higher speed than the ascending speed; the pressure of the water supplying the injectors is also preferably considerably reducedor even sometimes entirely cancelled during the descending movement of the frame 9.

When the carriage 9 arrives in its lower position, the finger 18 causes the lever 19*a* of the contactor 20*a* to rock, which has for an effect to control a fresh reversal of the direction of rotation of the motor 24, and the system 6 recommences a new cycle.

The operator may also choose to cause the system to act solely on one region of the patient's body, for example the region of the hips. It suffices to place the two contactors 20*a* and 20*c* respectively at the level of the top of the thighs and at the level of the patient's waist.

It will be understood that, by means of one or more intermediate contactors such as 20*b* and/or programmers known per se, it is also possible to vary the cycle of displacement of the frame 9 so as to massage, in accordance with the desired sequence, the different regions of a patient's body.

The foregoing is also applicable in the case of the cubicle not being filled with water and in the case of the frame 9 being replaced by the frame 42 in FIG. 7 or by the frame 44 in FIG. 8.

Of course, the invention is not limited to the embodiments which have just been described and numerous changes and modifications may be made thereto without departing from the domain of the invention.

For example, as has been seen, any means may be used for controlling and varying the mode, the speed and the amplitude of the displacement of the frame.

The shape and structure of the frame, the type and the number of injectors, the means and members for controlling the displacements of the frame may also be modified.

The invention also covers the case of the floor 8 on which the patient stands being vertically mobile under the action of actuation means such as a jack, the frame 9, 42, 44 itself being fixed or vertically mobile.

I claim:

1. A massage shower system (6), comprising injector means (7) adapted to be connected to a pressurized water supply for directing jets of water under pressure substantially radially towards the body of a patient standing up, a frame (9, 42, 44) supporting the injector means (7), and actuation means (10, 43) for moving the frame in a vertical reciprocating manner with respect to the patient, the actuation means displacing the frame during ascending movement between a lower position and an upper position along said vertical direction at a speed which varies from a minimum value to a maximum value.

2. The shower system according to claim 1 wherein both lower and upper positions are adjustable along said vertical direction.

3. A massage shower cubicle (1) equipped with a massage shower system (6) according to claim 2.

4. The shower cubicle according to claim 3 wherein the shower cubicle includes water-tight walls (2, 3, 4, 5) and is adapted to be filled at least partially with water, the massage shower system (6) being adapted to a movement of the frame (9, 42, 44) and to an operation of the injector means (7) in the water.

5. The shower system according to claim 1 wherein the actuation means returns the frame back rapidly from the upper position to the lower position.

6. The shower system according to claim 5 wherein the distance between the upper and the lower positions being split in contiguous successive segments, each segment corresponding to a region of the body of said patient, and the actuation means (10) comprises means (22, 23, 24) for communicating to the frame an ascending movement, the speed of which increases as the frame passes from the lower part to the upper part of said region.

7. The shower system according to claim 6 wherein the actuation means (10) comprises a cable (22) supporting the frame and wound on a drum (23) which comprises on its peripheral surface a helical groove (31) having a radius such that the speed of the frame: (i) increases from the lower part to the upper part of each region; and (ii), when reaching said upper part of a region, returns very rapidly to the value corresponding to the lower part of the next region located immediately above the preceding one.

8. The shower system according to claim 7 wherein the drum (23) comprises, from its distal end (32) fixed to an end (33) of the cable (22), a first zone (34) whose radius increases from a minimum value (Ro) and corresponding to the region of the patient legs going from the ankles to the knees, a second zone (35) whose radius increases from said minimum value (Ro) and which corresponds to the region of the patient thighs going from the knees to the top of the thighs, a third zone (36) whose radius remains constant and equal to said minimum value (Ro) and which corresponds to the region of the patient hips going from the top of the thighs to the waist, and a fourth zone (37) whose radius increases from said minimum value (Ro) and which corresponds to the patient back between the waist and the shoulders.

9. The shower system according to claim 6 wherein the shower system includes means (38) for varying the pressure of the water at the same time and in the same sense as the speed of the frame (9, 42, 44).

10. The shower system according to claim 9 wherein the varying pressure means (38) reduces the pressure of the water to a substantially zero value, while the frame (9, 42, 44) is returning rapidly from the upper to the lower position or is moving from the upper part of one region to the lower part of the next higher region.

11. The shower system according to claim 10 wherein the insector means (7) is adjustable in position and in orientation.

12. The shower system according to claim 1 wherein the distance between the upper and the lower positions begin split in contiguous successive segments, each segment corresponding to a region of the body of said patient, and the actuation means (10) comprises means (22, 23, 24) for communicating to the frame as ascending movement, the speed of which increases as the frame pass from the lower part to the upper part of said region.

13. The shower system according to claim 1 wherein the frame (42) is constituted by individual sectors (42*a*, 42*b*) independent of one another and the actuation means includes respective individual actuation means (43*a*, 43*b*) independent of one another.

14. The shower system according to claim 1 wherein the shower system includes means (38) for varying the pressure of the water as a function of the speed of the frame (9, 42, 44).

15. The shower system according to claim 14 wherein the variation of the pressure of the water is carried out at the same time and in the same direction as the speed of the frame (9, 42, 44).

16. The shower system according to claim 14 wherein the variation of the pressure of the water is proportional to the speed of the frame (9, 42, 44).

17. The shower system according to claim 14 wherein the variation of the pressure of the water is inversely proportional to the speed of the frame (9, 42, 44).

18. The shower system according to claim 1 wherein the insector means (7) is adjustable in position and in orientation.

19. A massage shower cubicle (1) equipped with a massage shower system (6) according to claim 1.

20. The shower cubicle according to claim 19 wherein the shower cubicle includes water-tight walls (2, 3, 4, 5) and is adapted to be filled at least partially with water, the massage shower system (6) being adapted to a movement of the frame (9, 42, 44) and to an operation of the injector means (7) in the water.

* * * * *